United States Patent [19]

Yamaguchi et al.

[11] Patent Number: 4,860,804

[45] Date of Patent: Aug. 29, 1989

[54] FILLED AMOUNT CONTROL SYSTEM

[75] Inventors: Shogo Yamaguchi; Hisashi Tazuke, both of Aichi, Japan

[73] Assignee: Mitsubishi Jukogyo Kabushiki Kaisha, Tokyo, Japan

[21] Appl. No.: 98,056

[22] Filed: Sep. 17, 1987

[30] Foreign Application Priority Data

Dec. 23, 1986 [JP] Japan ..... 61-19815[U]
Dec. 23, 1986 [JP] Japan ..... 61-198148[U]

[51] Int. Cl.[4] ..... B65B 31/00

[52] U.S. Cl. ..... 141/94; 141/65; 141/83; 141/192; 141/40

[58] Field of Search ..... 141/95, 94, 96, 83, 141/65, 59, 192, 198, 39, 40, 301, 302, 6, 93

[56] References Cited

U.S. PATENT DOCUMENTS

| | | | |
|---|---|---|---|
| 2,745,585 | 5/1956 | Lindars | 141/40 |
| 2,784,748 | 3/1957 | Eichenlaub | 141/65 |
| 3,313,326 | 4/1967 | Pellerino | 141/40 |
| 3,636,994 | 1/1972 | Lilljetorss | 141/83 |
| 3,760,852 | 9/1973 | Waxlax | 141/40 |
| 4,197,883 | 4/1980 | Mayer | 141/59 |
| 4,522,228 | 6/1985 | Campau | 141/198 X |
| 4,603,709 | 8/1986 | Huisma | 141/65 X |

FOREIGN PATENT DOCUMENTS 57-194989 11/1982 Japan .

*Primary Examiner*—Ernest G. Cusick
*Attorney, Agent, or Firm*—Wenderoth, Lind & Ponack

[57] ABSTRACT

A control system controls an amount of liquid filled into a container such as a bottle, a can or the like to be a predetermined amount in a precise and reliable manner. Liquid to be filled into the container is fed through a filling nozzle approximately up to a level somewhat higher than a predetermined target level. Then surplus liquid exceeding the predetermined target level is controllably ejected through an ejection nozzle piping having one end inserted into the container and opened at the target level. The surplus filled liquid is ejected through the ejection nozzle piping by suction or by pressure. When the ejection of the surplus filled liquid through the ejection nozzle piping begins, the pressure in the ejection nozzle piping changes from an initial valve. The end of ejection of the surplus filled liquid is detected by a pressure sensor disposed in the ejection nozzle piping. When the pressure sensor detects that the pressure in the ejection nozzle piping returns to the original pressure, a controller operates to stop a suction or pressure source.

4 Claims, 2 Drawing Sheets

FILLED AMOUNT CONTROL SYSTEM

BACKGROUND OF THE INVENTION

1. Field of the Invention

The present invention relates to a control system for use in a filling system in an apparatus for filling liquid into containers such as bottles, cans or the like.

2. Description of the Prior Art

Filling apparatuses in the prior art employed means for controlling a filled amount of liquid based on estimates or approximations [Japanese Laid-Open Patent Specification No. 57-194989 (1982)].

Upon discharging surplus filled liquid from a bottle, a can or the like under suction or increased pressure, if the suction or the increased pressure is maintained nearly constant and if the amount of time allowed for discharge under suction or increased pressure is sufficiently long, then the filled amount (net amount) can be maintained nearly constant.

However, in the following situations, the time for discharging under suction or increased pressure will vary, resulting in unequal filled amounts (net amounts) or in the necessity of increasing the time set for filling, and in either case filling efficiency is degraded:

(1) when the pressure for discharging under suction or increased pressure varies;

(2) when it is desired to discharge under suction or increased pressure during a minimum period of time by means of a large number of nozzles; or (3) when there is a fear that blocking may possibly occur in the nozzle for discharging under suction or increased pressure or that aging variation may possibly occur.

SUMMARY OF THE INVENTION

It is therefor an object of the present invention to provide a novel filled amount control system that is free from the above-described shortcomings of the prior art.

According to one arrangement of the present invention, a sensor for detecting pressure is provided in a piping for ejecting or discharging surplus filled liquid, a signal issued from the sensor is input to a controller, and the time for applying suction or increased pressure to the surplus filled liquid is controlled by such controller.

According to another arrangement of the present invention, sensors for detecting pressure are provided both in a gas feed nozzle piping for feeding pressurized gas into a container and in an ejection nozzle piping for discharging surplus filled liquid under increased pressure, and a time for applying increased pressure and discharging the surplus filled liquid is controlled by a pressure difference between the pressures detected in the respective pipings by these respective pressure sensors.

According to the first arrangement of the present invention, when surplus filled liquid is discharged under suction or increased pressure through an ejection nozzle, a pressure detected by the pressure sensor provided at a predetermined position in the ejection nozzle piping is different when the surplus filled liquid is flowing through the piping and when it is not flowing. Thus, the time for applying suction or increased pressure is controlled by the signal issued from the pressure sensor. Thereby, the amount of liquid filled into the container can be maintained constant in a reliable and stable manner, and also a suction or pressurizing operation over an unnecessarily long period of time can be avoided.

Furthermore, according to the second arrangement of the present invention, when surplus filled liquid is discharged under increased pressure, since a pressure difference between the pressures detected respectively by the pressure sensors provided at the respective predetermined positions in the gas feed nozzle piping and in the ejection nozzle piping is different when surplus filled liquid is flowing through the ejection nozzle piping and when it is not flowing, a time for pressurizing and forcing the surplus filled liquid from the container is controlled by such pressure difference. Therefore, in this case also, the amount of liquid filled into the container can be maintained constant in a reliable and stable manner, and at the same time, a pressurizing operation over an unnecessarily long period of time can be avoided.

Since the control system according to the present invention is constructed and operated in the above-described manner, the suction or pressurizing operation for surplus filled liquid can be carried out efficiently in a minimum necessary time, and also the amount of liquid filled into a container can be maintained constant at high precision.

Moreover, even a liquid that must be filled by pressure can be filled at high precision.

The above-mentioned and other objects, features and advantages of the present invention will become more apparent by reference to the following description of preferred embodiments of the invention taken in conjunction with the accompanying drawings.

Figure 1:
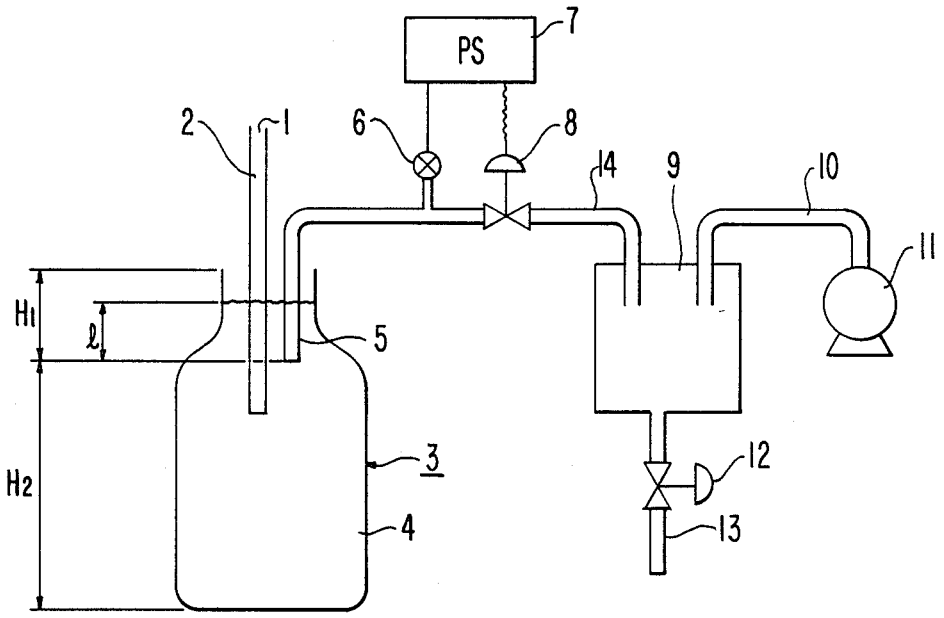
FIG. 1 is a schematic view showing a general construction of a first preferred embodiment of the present invention.
Figure 2:
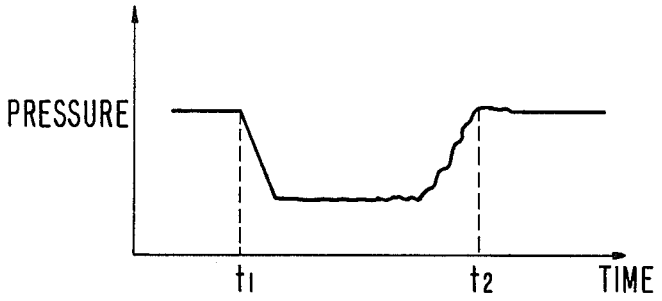
FIG. 2 is a diagram to be used for explaining an operation of the first preferred embodiment shown in FIG. 1.

DESCRIPTION OF THE PREFERRED EMBODIMENTS:

A first preferred embodiment of the present invention is illustrated in FIGS. 1 and 2.

This embodiment is an example of a filled amount control system of the type wherein the amount of liquid filled into a container is controlled by a suction system. In FIG. 1, reference numeral 1 designates an inlet for liquid to be filled, and numeral 2 designates a filling nozzle for filling the liquid to be filled into a container 3 such as a bottle, a can or the like. In order to maintain a filled level in the container 3 at a fixed position, that is, at a predetermined height $H_2$ from the bottom of the container or at a predetermined level which is lower than an opening of the container 3 by a distance $H_1$, surplus filled liquid is removed by suction through an ejection nozzle or discharge pipe 5 inserted into the container 3 to a predetermined level by means of an apparatus not shown. Reference numeral 6 designates a pressure sensor disposed in a piping 14 for the ejection nozzle 5, numeral 7 designates a controller adapted to receive a signal issued from the pressure sensor 6, numeral 8 designates a control valve disposed in the piping 14 for the ejection nozzle 5 and controlled by the controller 7, numeral 9 designates a separator into which opens a remote end of the piping 14 for the ejection nozzle, numeral 10 designates a suction piping having one end opening into the separator 9 and another end communicating with a suction device 11, and numeral 13 designates a return piping or a drain piping provided with a valve 12 and connected to the separator 9.

In operation, liquid to be filled 4 is filled through the filling nozzle 2, and surplus filled liquid existing above an open end of the ejection nozzle 5 is withdrawn by suction through the ejection nozzle 5. During such liquid withdrawal, as shown in FIG. 2, the pressure in the ejection nozzle piping 14 detected by the pressure sensor 6 lowers, but when removal of the surplus filled liquid has been completed, the pressure detected by the pressure sensor 6 returns nearly to the original pressure. Time $t_1$ in FIG. 2 is the moment of commencement of removal of surplus filled liquid, and time $t_2$ is the amount when the suction for the surplus filled liquid has ceased. In this way, the pressure sensor 6 detects that the suction for the surplus filled liquid has ceased, and then either the control valve 8 is closed by the controller 7 or the suction apparatus 11 is stopped by the controller 7 through a process not shown. Thereby the amount of the filled liquid within the container 3 can be controlled to be a predetermined amount, there is no need to continue suction over an unnecessarily long time, and a highly precise net amount of filled liquid can be realized efficiently.

In the separator 9 shown in FIG. 1, the removed surplus filled liquid is separated from gas that was removed simultaneously, and then it is passed through the liquid valve 12 and the piping 13 either to be returned to a source of the liquid or to be drained.

It is to be noted that while ejection of surplus filled liquid is effected by a suction system in the above-described embodiment, the present invention is equally applicable to the type of ejection system wherein a liquid level in a container is subjected to an elevated pressure and thereby the surplus filled liquid is forced out by such pressure (pushed out).

Figure 3:
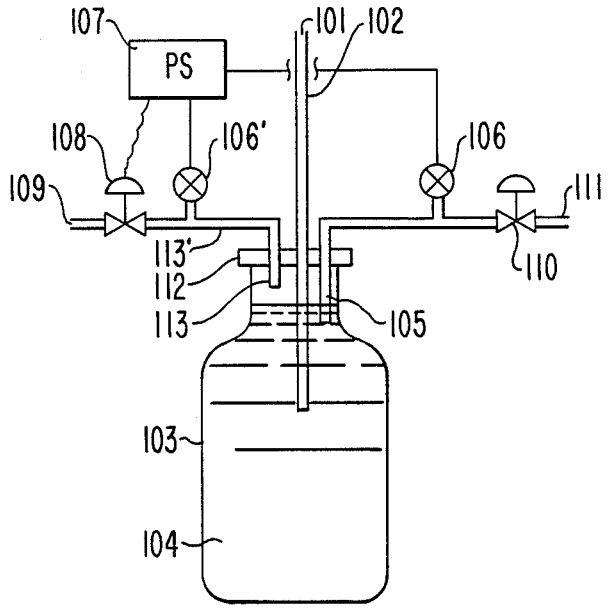
FIG. 3 is a schematic view showing a general construction of a second preferred embodiment of the present invention.
Figure 4:
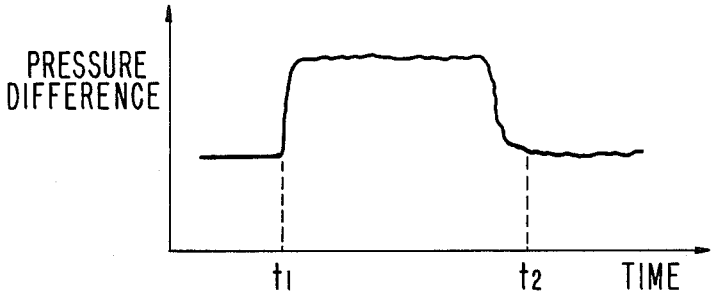
FIG. 4 is a diagram to be used for explaining an operation of the second preferred embodiment shown in FIG. 3.

A second preferred embodiment of the present invention is illustrated in FIGS. 3 and 4, in which the amount of liquid filled into a container is controlled by such a pressurizing system. In FIG. 3, reference numeral 101 designates an inlet for liquid to be filled, and numeral 102 designates a filling nozzle for filling the liquid to be filled into a container 103 such as a bottle, a can or the like. In order to maintain the amount of liquid filled into the container 103 at a predetermined amount, pressurized gas is introduced from an inlet 109 into a gas feed nozzle piping 113' and it is fed into the container 103 through a gas feed nozzle 113 at the end of the gas feed nozzle piping 113'. Reference numeral 108 designates a gas feed control valve provided in the gas feed nozzle piping 113'. Reference numeral 105 designates an ejection nozzle or discharge pipe provided in an end portion of an ejection nozzle piping 111, and it is inserted into the container 103 to a predetermined level by means of an apparatus not shown. Reference numeral 110 designates an ejection valve provided in the ejection nozzle piping 111 and capable of closing or appropriately regulating the degree of opening of piping 111. In some cases, the ejection nozzle piping 111 may be provided with a separator, not shown, to separate the ejected surplus filled liquid and to return it to a liquid source or to drain. Reference numeral 112 designates a seal member for maintaining gas-tightness of the container 103.

Reference numeral 106 designates a pressure sensor disposed in the ejection nozzle piping 111, numeral 106' designates another pressure sensor disposed in the gas feed nozzle piping 113', and the arrangement is such that signals issued from the respective pressure sensors are input to a controller 107, and the gas feed control valve 108 may be controlled on the basis of a pressure difference between the respective pipings derived from the sensor signals in the controller 107.

In operation, at first the gas feed valve 108 is opened with the ejection valve 110 kept fully closed, and after the interior of the container 103 has been pressurized, liquid to be filled 104 is supplied into the container 103 through the filling nozzle 102. Upon commencement of such filling, the ejection valve 110 is opened (note that the ejection valve 110 is appropriately regulated such that the amount of ejected gas is less than the amount of gas fed). When the liquid 104 fed through the filling nozzle 102 exceeds a predetermined amount, the level of the filled liquid 104 rises higher than the open end of the ejection nozzle 105. Thus, surplus filled liquid above this level is discharged through the ejection nozzle 105 by the pressure within the container 103. In addition, when the open end of the ejection nozzle 105 has been closed by the filled liquid in the above-described manner, the gas feed nozzle piping 113' and the ejection nozzle piping 111 are cut off from each other. Hence, a difference between the pressures in the respective pipings detected by the pressure sensors 106 and 106' will increase.

As indicated by the diagram in FIG. 4, the pressure difference increases from time $t_1$ at the commencement of surplus liquid ejection, and such increased pressure difference continues while ejection is effected continuously. At time $t_2$ when the ejection of the surplus filled liquid is completed and stops, the gas feed nozzle piping 113' and the ejection nozzle piping 111 are communicated with each other and the pressure difference therebetween is restored to the original low level. In this way, the ending of the operation of forcing of the surplus filled liquid from the container is detected by the pressure sensors 106 and 106'. The gas feed control valve 108 then is closed by the controller (pressure switch) 107, and thereby the amount of the filled liquid in the container 103 can be controlled to be a predetermined amount. Therefore, there is no need to feed gas for pressurizing over an unnecessarily long period of time, and the net amount of the liquid in the container can be maintained constant with high precision in an efficient manner.

Since many changes and modifications can be made to the above-described constructions without departing from the spirit of the present invention, it is intended that all matter contained in the above description and shown in the accompanying drawings shall be interpreted to be illustrative and not as limiting to the scope of the invention.

What is claimed is:

1. A control system for regulating the amount of liquid filled into a container to be a predetermined amount and for use with a filling system that can supply to the container an amount of the liquid in excess of said predetermined amount, said control system comprising:

a liquid discharge member adapted to extend into a container to be filled with liquid and having an inlet opening to be positioned within the container at a level whereat liquid filled into the container up to such level corresponds to said predetermined amount;

means for applying to the interior of the container a pressure different than atmospheric pressure, and thereby for causing, upon the liquid being filled into the container above said level, liquid to pass through said inlet opening and said liquid discharge member until the level of liquid in the container reduces to said level;

pressure sensor means, operatively connected to said liquid discharge member, for detecting a first pressure condition therein during passage of liquid therethrough, for detecting a second pressure condition thereof upon stopping of passage of liquid therethrough, and for generating first and second signals representative of said detected first and second pressure conditions, respectively; and controller means, operatively connected to said pressure sensor means for receiving said signals therefrom, and operatively connected to said pressure applying means for, upon receipt of said second signal from said pressure sensor means, stopping application of said pressure to the interior of the container.

2. A control system as claimed in claim 1, wherein said liquid discharge member comprises an outlet pipe to extend into the container, and said inlet opening comprises an open end of said pipe.

3. A control system as claimed in claim 2, wherein said pressure applying means comprises a vacuum source connected to said pipe, said pipe has therein a control valve for controlling application of vacuum to said open end of said pipe, said first and second pressure conditions respectively comprise relatively lower and higher pressures in said pipe, said pressure sensor means comprises a single pressure sensor detecting said lower and higher pressures in said pipe and generating said first and second signals in response thereto, and said controller means comprises a pressure switch receiving said first and second signals from said single pressure sensor and opening and closing, respectively, said control valve in response thereto.

4. A control system as claimed in claim 2, wherein said pressure applying means comprises a gas feed pipe to extend into the container for supplying thereto gas at a pressure above atmospheric pressure, said gas feed pipe has therein a control valve for controlling the supply of said pressurized gas, said pressure sensor means comprises a first pressure sensor detecting the pressure in said outlet pipe, further comprising a second pressure sensor detecting the pressure in said gas feed pipe, and said controller means comprises a pressure switch responsive to signals from said first and second pressure sensors to indicate a change in pressure difference between said gas feed pipe and said outlet pipe, indicative of said first and second pressure conditions, for opening and closing, respectively, said control valve in response thereto.

* * * * *